US006038897A

United States Patent [19]

Dawson et al.

[11] Patent Number: 6,038,897

[45] Date of Patent: Mar. 21, 2000

[54] BACK COVER LOCK FOR A COMBINATION LOCK

[75] Inventors: Gerald L. Dawson, Lexington; James P. Redden, Bayberry, both of Ky.

[73] Assignee: Mas-Hamilton Group, Inc., Lexington, Ky.

[21] Appl. No.: 09/157,020

[22] Filed: Sep. 18, 1998

[51] Int. Cl.[7] ..... E05B 37/08

[52] U.S. Cl. ..... 70/303 A; 70/443; 70/333 R; 70/289

[58] Field of Search ..... 70/333 R, 443, 70/289, 283, 303 A, 277, 278.4, 303 R, 320, 326, 371; 292/172, 144

[56] References Cited

U.S. PATENT DOCUMENTS

| | | | |
|---|---|---|---|
| 237,657 | 2/1881 | Zube | 70/289 |
| 2,061,638 | 11/1936 | Segal | 70/371 |
| 2,131,315 | 9/1938 | Dunseath | 70/371 |
| 3,038,325 | 6/1962 | Maynard | 70/443 |
| 3,207,541 | 9/1965 | Bartlett | 70/289 |
| 3,637,180 | 1/1972 | Parry | 70/371 X |
| 4,512,167 | 4/1985 | Remenicky | 70/443 |
| 4,782,676 | 11/1988 | Friedman | 70/289 |
| 4,914,932 | 4/1990 | Walla | 70/371 X |
| 5,257,519 | 11/1993 | Miller, III | 70/303 A |
| 5,592,838 | 1/1997 | Clark et al. | 70/303 A |
| 5,881,589 | 3/1999 | Clark et al. | 70/278 |

FOREIGN PATENT DOCUMENTS

| | | | |
|---|---|---|---|
| 3628294 | 2/1987 | Germany | 70/371 |
| 2123474 | 2/1984 | United Kingdom | 70/371 |

*Primary Examiner*—Teri Pham

*Attorney, Agent, or Firm*—Rustan J. Hill; Laurence R. Letson

[57] ABSTRACT

A mechanism for locking the back cover of a combination lock to the lock housing is described having two sequentially and phased moveable parts, each having an aperture through which a locking member may be inserted, the apertures are disposed in parts moveable in parallel and adjacent planes and a portion of each aperture is at all times aligned with the other aperture such that a third member may extend through the apertures. The apertures have enlarged portions which will pass the third member and channel portions which prevent withdrawal of the third member while permitting movement of the moveable parts. The third member is carried by the back cover of the lock and can only be withdrawn by sequentially withdrawing from a first moveable part, shifting the moveable parts to a second position and withdrawing from the second moveable part. The back cover may thus be only removed by starting with the bolt in an extended position and locked condition and prior to final withdrawal of the third member, withdrawing the lock bolt to an unlocked position, necessitating possession of authorization to unlock the lock in order to remove the back cover.

5 Claims, 4 Drawing Sheets

BACK COVER LOCK FOR A COMBINATION LOCK

FIELD OF THE INVENTION

This invention relates to combination locks and, more specifically, to the back cover of an electronic lock that may be made more secure by locking the back cover onto the lock case and rendering it removable only by one authorized to open the lock.

BACKGROUND OF TIE INVENTION

The lock case or lock housing of a combination lock typically resides inside a container, such as a safe, vault or room, with the lock front exposed outside the container. Once the lock is unlocked, the operator may open the container and thus has access to the lock housing and the lock case back cover. The back cover is typically removable with common hand tools such as a screwdriver. Removal of the back cover permits access to the inner workings of the lock and presents an additional opportunity to defeat the lock's reliability or security as well as the potential to gain unauthorized access to the container at a later time.

Various lock-on back covers have been designed; the most notable, one effectively, is a housing covering the lock housing and uses a separate key lock to secure it covering the combination lock. The back cover of a lock without a locked on back cover can be removed by anyone who may have access to the lock housing, including those without authorization to open the lock.

Pedestrian door locks, particularly offer the most prevalent instance for one without authorization to have access to the lock housing and lock cover; i.e., a combination lock is used in conjunction with a Mas-Hamilton CDX-07® lock or similar device. Anyone in the room, even if not in the possession of an authorized combination, could remove the back cover with a screwdriver. The Mas-Hamilton CDX-07 lock is available from Mas-Hamilton Group, Lexington, Ky. Other similar devices are manufactured and sold by Sargent & Greenleaf, Inc. and Lockmasters, Inc., both of Nicholasville, Ky.

To overcome this security exposure of having the back cover removed by a person who does not have the authority to operate the lock, it is desirable to lock the back cover onto the combination lock housing in such a way as to prevent its removal unless the lock is operated to unlock the lock as part of the back cover removal process. This insures that only a person in possession of the lock combination, and the authority to operate the lock may remove the back cover.

OBJECTS OF THE INVENTION

It is an object of the invention to prevent unauthorized access to the interior of a combination lock case.

It is another object of the invention to lock the back cover of a combination lock onto the lock body.

It is further an object of the invention to prevent unauthorized removal of the back cover of a combination lock housing.

It is a still further object of the invention to permit back cover removal from a combination lock only upon operation of the lock.

SUMMARY OF THE INVENTION

In the combination lock disclosed, the bolt has an extended portion forming a geared rack for engagement with a partial gear for bolt withdrawal. The lock mechanism is also comprised of a slide, driven by dial rotation, responsive to an enabling electrical motor positioning of a partial idler gear to translate the slide from a locked and blocking position to an unlocked and unblocking position relative to the lock bolt. The slide and the bolt move orthogonally to the other in a sequenced relation. The slide and the bolt each have an elongated opening formed therein to accommodate a pin-like member. The slide and bolt and their respective elongated openings move relative to the pin-like member which is extended through the openings.

The pin-like member has a head which may pass through enlarged portions of the elongated openings, permitting assembly and removal of the back cover, when properly aligned with the enlarged portions. However, the sequential movement of the bolt and slide are such that the enlarged portions do not align with each other at any time in their sequence of operational positions. Therefore, the alignment of each enlarged portion of the elongated openings with the pin-like member occurs separately and in a sequenced relationship. This sequential alignment permits assembly and removal of the pin-like member with respect to the slide and bolt but in a sequence of steps dependent upon and responsive to the movement and positions of the slide and bolt.

Assembly and removal of the lock-on back cover with respect to the lock housing require that the slide and bolt be sequentially moved to predetermined positions to permit withdrawal of the pin-like member. Movement of the slide and the bolt, generally and specifically to remove the back cover requires possession of the authorized lock combination and operation of the lock from the locked condition to the unlocked condition. Therefore, the operation of the lock to remove the back cover may be accomplished only by a person having possession of the authorized combination to open the lock.

A better understanding may be had from the attached drawings and the following Detailed Description of the Invention.

DETAILED DESCRIPTION OF THE BEST MODE OF THE PREFERRED EMBODIMENT OF THE INVENTION

This invention may be implemented into combination locks in general but is particularly useful and adaptable into a lock of the type disclosed in U.S. Pat. No. 5,581,598 Thomas R. Clark, et al.

Figure 1:
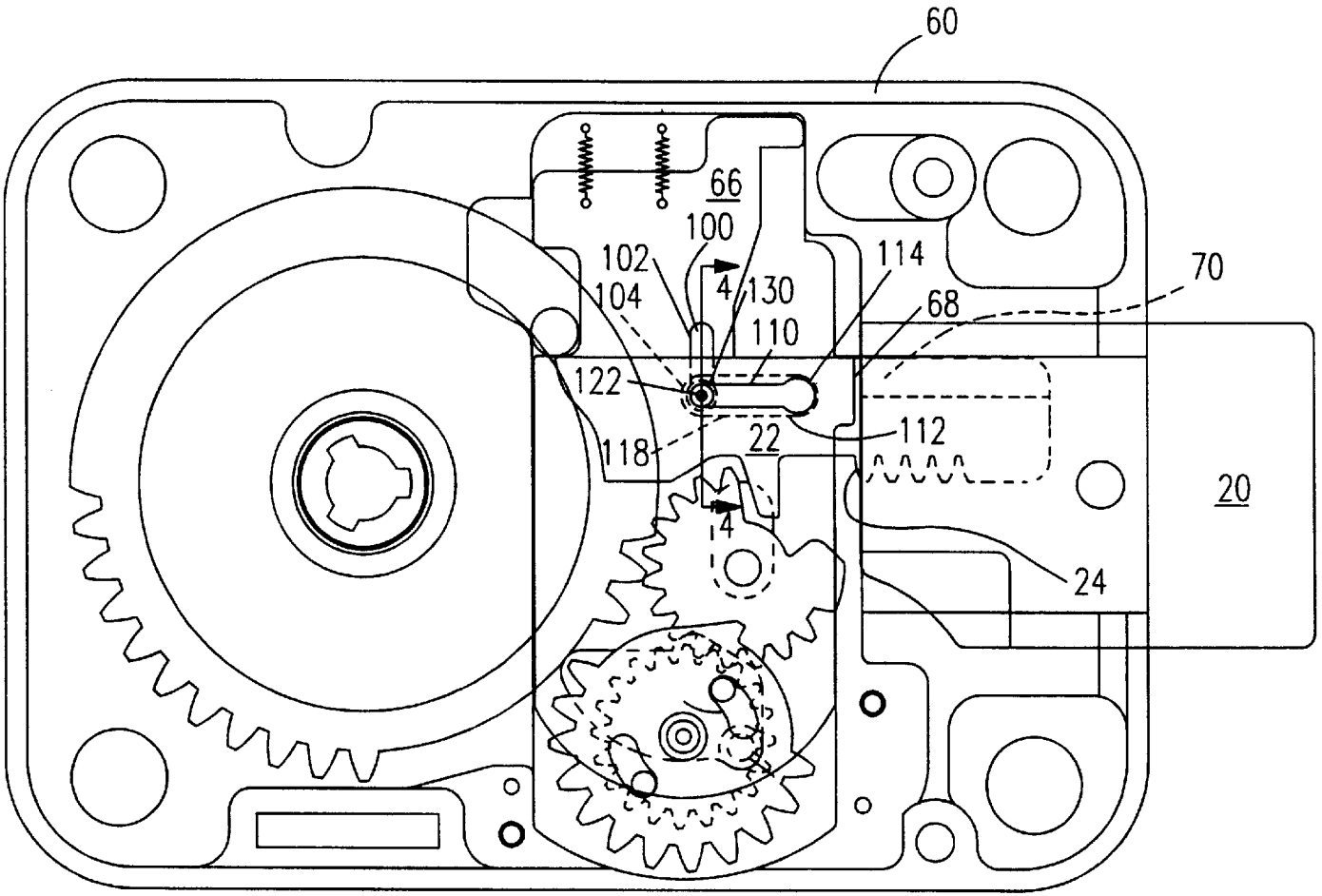
FIG. 1 is an illustration of the internal mechanical components of a combination lock in the locked condition.
Figure 2:
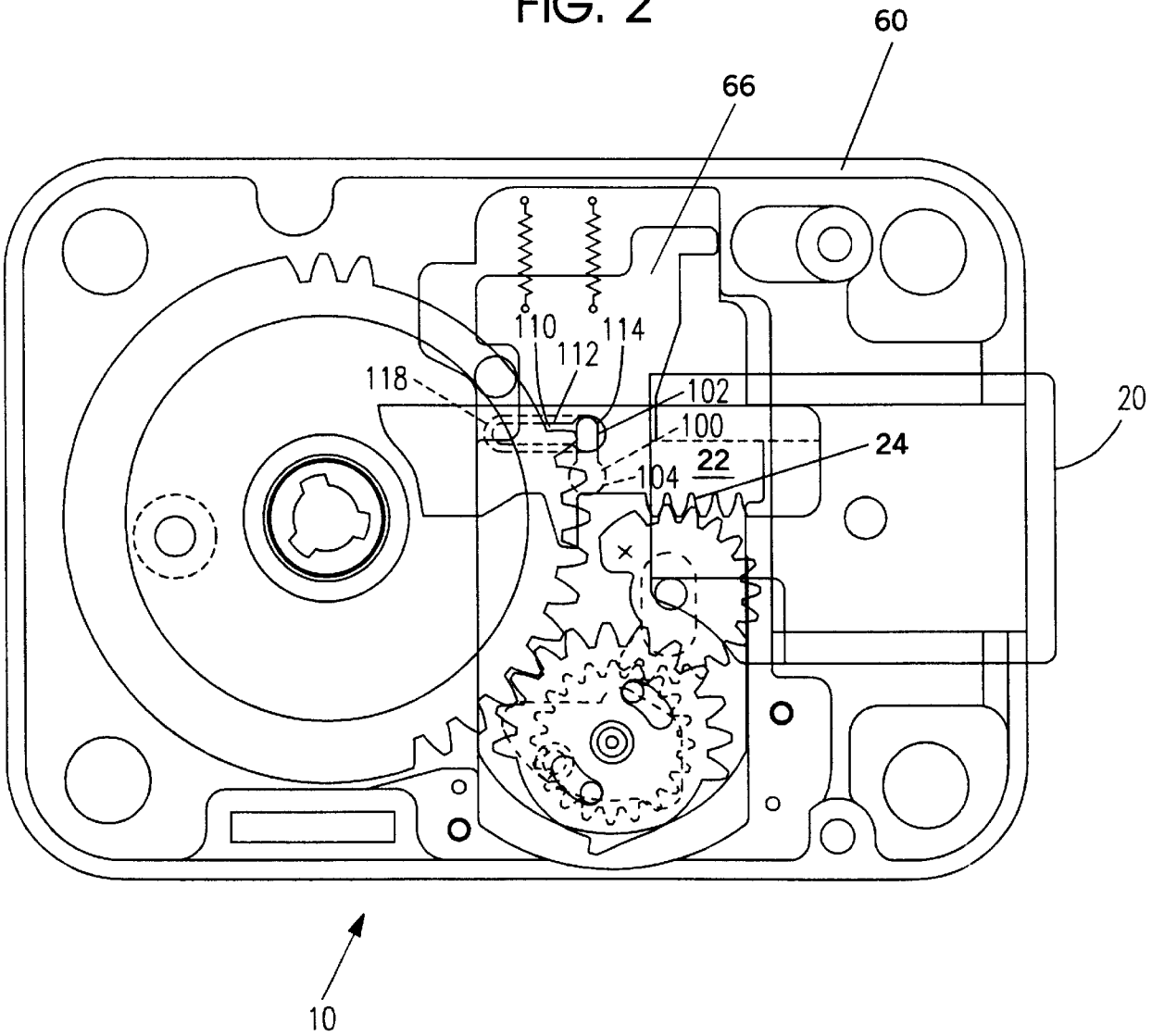
FIG. 2 is an illustration of the internal mechanical components of a combination lock in the unlocked condition.

Referring now to FIGS. 1 and 2, an elongated aperture 100 is formed into slide 66 by any conventional process suitable for such purpose. The elongated aperture 100 comprises a channel portion 102 and an enlarged portion 104, generally circular in shape; however, other shapes may be used.

Bolt 20 has an extension 22, which is part of a rack 24 in turn, which is disposed to translate bolt 20 between its locked, extended position and its withdrawn, unlocked position. Extension 22 similarly is provided with an elongated aperture 110, which is made up of channel 112 and enlarged portion 114, which similarly may be generally circular in shape. Other shapes for enlarged portion 114 may be used as desired so long as the shapes of enlarged portions 104 and 114 are the same. Aperture 110 is disposed to overlie aperture 100. The lengths of apertures 100 and 110 and, particularly, channel portions 102, 112, are designed so that the two apertures 100, 110 overlap without regard to the positions of the slide 66 and bolt 20 within their normal ranges of movement. Bolt 20 also is formed with a shallow channel or relief 118 cut into the extension 21, and aligned with aperture 110. The shallow channel 118 is dimensioned to freely accept head 130 of rod-like member 122 as may be seem in FIG.4.

Figure 3:
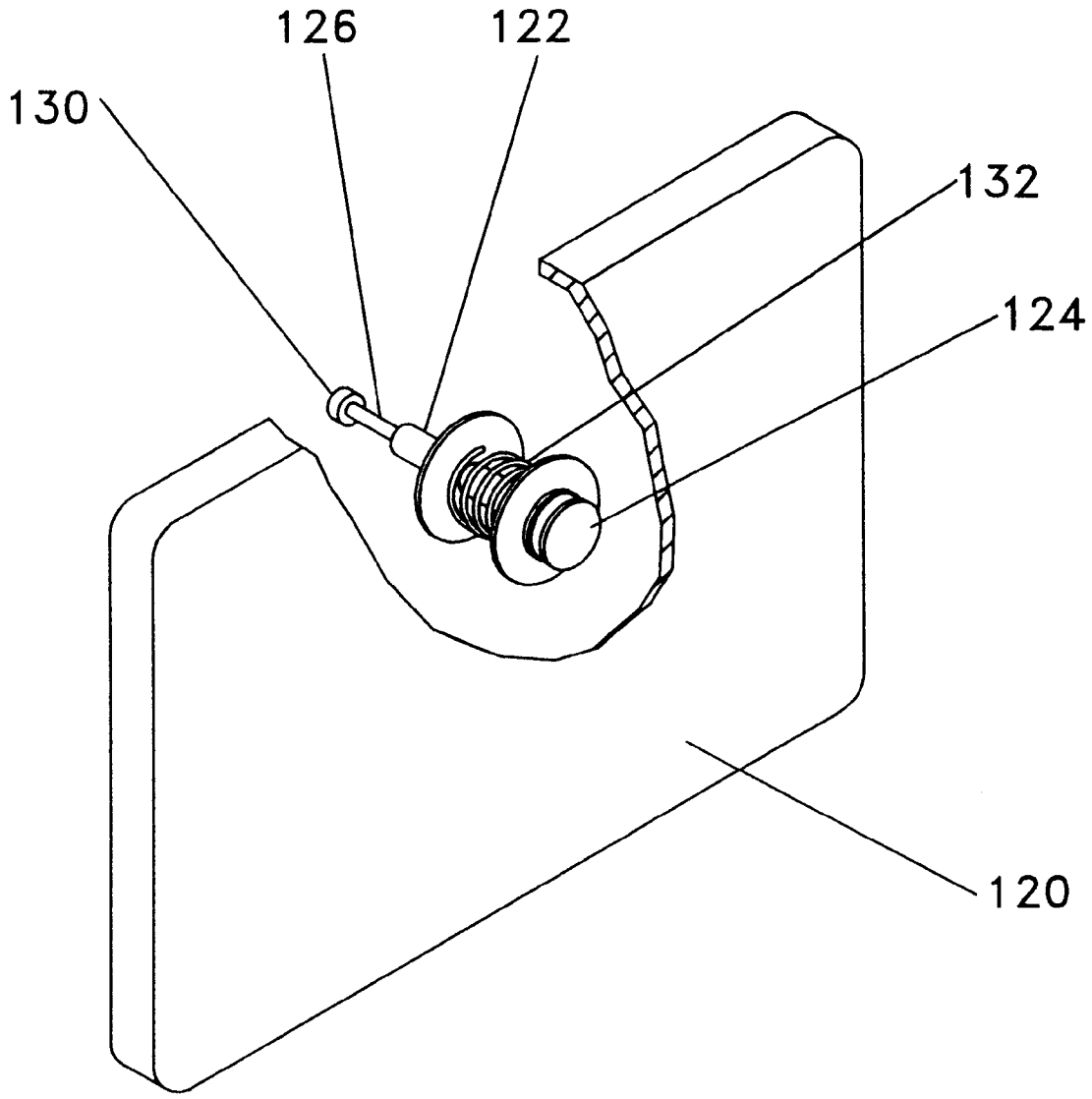
FIG. 3 is a perspective view of a portion of the lock cover supported on the back cover.
Figure 4:
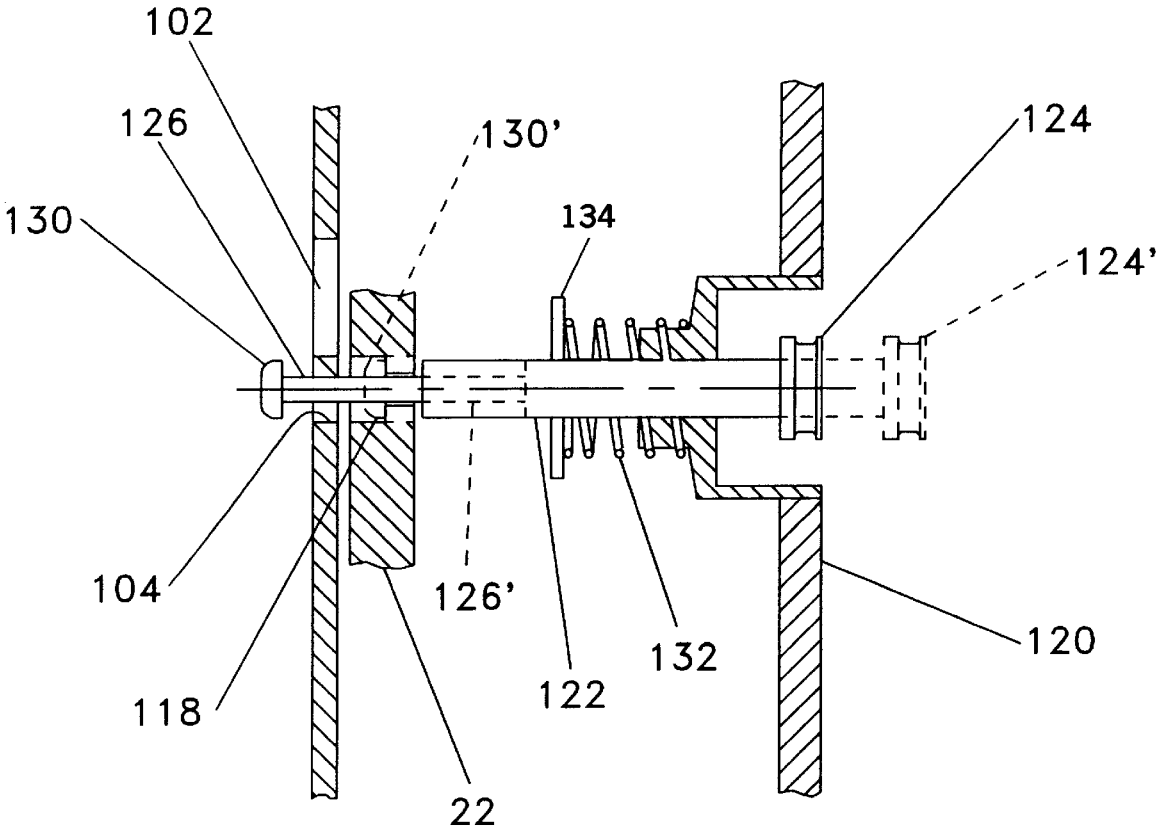
FIG. 4 is a sectional view taken along line 4—4 in FIG. 1 of the back cover lock.

The back cover 120 of the lock housing 60 supports a spring biased rod-like member 122 which may be observed in FIGS. 3 and 4. Rod-like member 122 preferably is provided with an enlarged finger or fingernail graspable head 124 in order to allow the operator to pull member 122 axially outward from cover 120. Member 122 is further formed having a reduced diametral section 126, forming a head 130 on the end of member 122. For ease of design and manufacture, head 130 preferably is round, but other shapes could be used, including square or other polygonal shapes. Reduced diameter section 126 and channel portions 102, 112 of aperture 100, 110 are dimensioned and disposed such that channel portions 102, 112 may slide freely relative to member 122, as illustrated in FIG. 4, but head 130 may not be pulled through channel portions 102 or 112.

Rod-like member 122 and head 130 are designed to pass through the apertures 100, 110, specifically enlarged portions 104, 114 respectively of slide 66, and bolt extension 22. Head 130 may align with enlarged portions 104, 114 only at predetermined stages of operation of lock 10. The head 130 and member 122 are aligned with enlarged portion 114 of aperture 110 only when the lock 10 is unlocked and bolt 20 and bolt extension 22 are fully withdrawn.

Similarly, member 122 and head 130 may be aligned with the enlarged portion 104 of aperture 100 in slide 66 when the lock 10 is locked and the bolt 20 fully extended.

At all other phases of the sequenced operation of lock 10, the member 122 aligns with the intersection of channel portions 102, 112 of apertures 100, 110.

Referring now to FIGS. 3 and 4, rod-like member 122 is spring biased by compression spring 132 to a fully extended position. This spring relief and bias allows the head 130 to be moved into enlarged portions 104 and 114 of apertures 100 and 110 whenever the back cover 120 is positioned on and attached to the lock housing 60.

To assemble the back cover 120 to the lock case 60, the back cover 120 is aligned with the lock body 60, when the lock 10 is in an unlocked condition, and the bolt 20 is fully withdrawn. The head 130 of rod-like member 122 is inserted into the enlarged portion 114 of aperture 110. Back cover 120 then may be forced against spring 132 and capture clip 134 and fastened to lock body 60 in a conventional manner. Lock 10 then is operated in its customary manner to extend the bolt 20 during the locking operation and to lock the lock 10. The bolt extension 22 moves relative to member 122 and until head 130 becomes trapped in channel 18 between bolt extension 22 and slide 66. As the bolt 20 is fully extended, the abutment portion 68 of slide 66 clears blocking member 70 of bolt 20 as seen in FIG. 1. Upon clearance of blocking member 70 by abutment portion 68, slide 66 is moved by spring force to its locked and blocking positions and aperture 100 is moved and aligns enlarged portion 104 with head 130. Upon such alignment, head 130 will move through the enlarged position 104 of aperture 100 under the bias influence of spring 132.

Operation of the lock 10 is unaffected by member 122 extending through the bolt extension 22 and slide 66 as the channel portions 102, 112 of apertures 100, 110 translate past member 122 during normal lock operation.

Removal of the back cover 120 of lock 10 is initiated by conventional operation of the lock 10 to the point that the combination has been entered, bolt 20 remains extended, and is ready for withdrawal. The manually graspable head 124 is pulled to the position indicated at 124', and head 130 is pulled through enlarged portion 104 of aperture 100 into channel 118. While manually holding head 124 in position 124', the lock 10 is operated to complete its unlocking, slide 66 displacement and bolt extension 22 and bolt 20 withdrawal. As the manual input is supplied to withdraw the bolt 20, slide 66 is driven downward, as viewed in FIGS. 1 and 2, and presents the channel portion 102 behind head 130, thereby blocking restoration of member 122.

As withdrawal of the bolt 20 is completed, the enlarged portion 114 of aperture 110 is presented in alignment with head 130 and head 130 may be withdrawn therefrom, permitting the complete removal of back cover 120 from lock case 60.

Because the removal of back cover 120 from the lock case 60 requires the lock 10 to be fully locked with the bolt 20 fully extended at the initiation of back cover 120 removal operations, the lock 10 thereafter must be operated to unlock the lock 10 while sequentially withdrawing member 122 and head 130 from slide 66 and bolt extension 21. Thus, an operator removing the back cover 120 must operate the lock 10 in order to remove the back cover 120, thus necessitating possession of the authorized combination.

A lock-on back cover such as disclosed greatly enhances the overall security of a combination lock.

One of skill in the art will appreciate that minor changes may be made to the design of the invention without affecting the advantage of the invention and without removing the lock or back cover from the scope of protection afforded by the attached claims.

We claim:

1. A combination lock comprising:

a lock housing enclosing a lock bolt, a lock bolt withdrawal mechanism and a slide;

said slide displaceable from a first position blocking withdrawal movement of said lock bolt to a position permitting said withdrawal movement of said lock bolt;

said bolt comprising a protruding member extending substantially parallel to a reciprocatory axis of movement of said lock bolt;

said slide formed to define a first elongated aperture therein, said aperture having an enlarged portion and a channel portion;

said protruding member of said lock bolt formed to define a second elongated aperture therein having an enlarged portion and a channel portion;

said first and second elongated apertures disposed to present said respective elongated apertures aligned parallel to a reciprocatory axis of movement of said slide and said reciprocatory axis of said lock bolt, respectively and said first and second elongated apertures further disposed so that a common axis extends through both said slide and said bolt as well as through said first and said second elongated apertures;

a back cover mountable to said lock housing;

a rod-like member extending through said back cover coaxial with said axis extending through said slide and lock bolt, said rod-like member comprising an enlarged head portion sized and configured to pass through said enlarged portions of said elongated apertures, but not capable of passage through said channel portions;

said enlarged portions further disposed and operably driven so that said enlarged portions are not aligned with each other at any point in the operation of said lock, and wherein said enlarged portion of said aperture of said slide are aligned with said head of said rod-like member whenever said lock is in a locked condition and said head of said rod-like member may be pulled therethrough only at that point of said lock operations and said head may not be pulled through said protruding member until said lock bolt is subsequently retracted, thereby locking said back cover to said lock housing and said back cover may not be removed by anyone not having authorization to operate said lock.

2. The combination lock of claim 1 wherein said slide is movable sequentially prior to the movement of said bolt and said first elongated aperture is translated sequentially prior to movement of said second elongated aperture, whereby said enlarged portion of said first elongated aperture is displaced away from alignment with said rod-like member prior to translation of said second elongated aperture to a location where said enlarged portion of said second elongated aperture is aligned with said rod-like member, thereby assuring that said rod-like member may only be withdrawn from said elongated apertures during a sequenced movement of said slide and said bolt, said sequenced movement being the same sequence executed by said slide and said bolt during unlocking of said lock.

3. The combination lock of claim 2 wherein said protruding member further comprises a relief channel of a width to accommodate said enlarged head portion and a depth sufficient to accept said enlarged head portion and not interfere with said slide.

4. A lock comprising:

a lock case, said case including a back cover;

a pair of displaceable members contained within said case, each said displaceable member having one of a pair of elongated apertures, each said aperture having an enlarged portion and a channel portion;

a lock bolt supported by said case;

a third displaceable member having an enlarged head thereon, said head sized to pass through said enlarged portions, but not pass through said channel portions, said third displaceable member displaceably mounted on said back cover and not externally removable therefrom;

said third displaceable member disposed extending through said elongated apertures;

said elongated apertures displaceable with respect to each other responsive to locking and unlocking operations of said lock and disposed to not align both of said enlarged portions at any portion of said operations of said lock and to align a first one of said enlarged portions with said head when said lock bolt is extended and to align said second enlarged portion with said head when said lock bolt is withdrawn, whereby said third displaceable member is selectively displaced through said first enlarged portion, said lock operated to withdraw said bolt and said head displaced through said second enlarged portion, preventing removal of said back cover of said lock except upon a sequence of operations of:

displacement of said third displaceable member to the maximum extent possible through said first enlarged portion with said lock bolt extended;

unlocking of said lock by withdrawing said lock bolt; and withdrawal of said third displaceable member from said second enlarged portion only when said lock is unlocked with the said lock bolt withdrawn.

5. The lock of claim 4 wherein said third displaceable member further comprises a reduced cross section of such dimension as to pass through said channel portions of said pair of elongated apertures.

* * * * *